US005393388A

United States Patent [19]

Herrmann et al.

[11] Patent Number: 5,393,388

[45] Date of Patent: Feb. 28, 1995

[54] ELECTROLYTIC PROCESS FOR EXTRACTING HIGH PURITY PLATINUM FROM PLATINUM ALLOYS

[75] Inventors: Sigrid Herrmann; Uwe Landau, both of Berlin, Germany

[73] Assignee: Schott Glaswerke, Mainz, Germany

[21] Appl. No.: 170,421

[22] Filed: Dec. 20, 1993

[30] Foreign Application Priority Data

Dec. 18, 1992 [DE] Germany ..... 4243697

[51] Int. Cl.[6] ..... C25C 1/20

[52] U.S. Cl. ..... 204/109; 204/111; 204/126; 204/140

[58] Field of Search ..... 204/109, 111, 126, 140; 205/255, 264

[56] References Cited

U.S. PATENT DOCUMENTS 4,775,452 10/1988 Kuninaga et al. ..... 204/146

FOREIGN PATENT DOCUMENTS 0253783 1/1988 European Pat. Off. .
594408 3/1934 Germany .
02038536 2/1990 Japan .
157785 1/1921 United Kingdom .

*Primary Examiner*—John Niebling
*Assistant Examiner*—Brendan Mee
*Attorney, Agent, or Firm*—Michael J. Striker

[57] ABSTRACT

The electrolytic process for obtaining platinum of high purity from concentrated hydrochloric acid solutions of a platinum alloy containing Rh, Ir and/or Pd proceeds with simultaneous depletion of noble and base metal impurities from the solution. This electrolysis process takes place in an electrolysis cell having an anode and cathode and subdivided by a teflon cation exchanger membrane under potentiostatic or, voltage-controlled conditions with a potential applied across the anode and cathode of 8 V to 16 V, preferably 11.5 to 12 V, at a current density of 12.5 to 37.5 A/dm$^2$, preferably 22.5 to 35 A/dm$^2$, to form a purified platinum-containing solution from which the high purity platinum can be obtained and also platinum alloy metal component deposits on the anode and cathode. The concentrated hydrochloric acid solution of the platinum alloy can have a platinum alloy content of 50 to 700 g/l and total metal impurities of not greater than 5000 ppm.

27 Claims, No Drawings

ELECTROLYTIC PROCESS FOR EXTRACTING HIGH PURITY PLATINUM FROM PLATINUM ALLOYS

BACKGROUND OF THE INVENTION

The present invention relates to methods of obtaining high purity platinum from platinum alloys and, more particularly, to obtaining high purity platinum by electrolytic methods.

The present invention concerns an electrolytic process for extracting platinum of high purity from a concentrated hydrochloric acid solution of an alloy of platinum and Rh, Ir and/or Pd under simultaneous depletion of other noble and base metal impurities present in the alloy.

Platinum alloy is used in many industrial applications, for example in thermocouple elements, in catalysts for ammonia oxidation, in organic chemistry, in automobile exhaust catalytic converters, in dental technology and many other areas. Depending on the chemical and other production processes concerned, these alloys are sent to noble metal processing plants after a certain period of time in the form of scrap platinum alloy and are chemically separated and refined in those plants to obtain platinum.

The classical separation of platinum from Rh, Ir and/or Pd occurs by precipitation in the form of $(NH_4)_2[PtCl_6]$. Due to the very similar chemical properties of the foregoing metals, however, this process involves a substantial amount of labor and is time-consuming.

The separation of the platinum from the iridium is particularly complicated, since both metals are present in the same stable valency (IV) and, during precipitation with $NH_4Cl$, form salts with almost identical properties.

A rough separation is only possible if the iridium IV cation is converted into the iridium III oxidation state. During subsequent precipitation of the platinum with $NH_4Cl$, coprecipitation of the iridium occurs nonetheless. Similar conditions are observable during separation of the platinum from the rhodium and palladium. The precipitated $(NH_4)_2[PtCl_6]$ contains large amounts of Rh and Pd. Reprecipitation or recrystallization steps are therefore required for further purification.

German Patent DE-PS 272 6558 describes a process for separating platinum from iridium by means of ion exchangers. This process merely results in platinum-containing iridium.

A large number of extraction processes are known for precipitation of platinum alloys, which, however, also require subsequent precipitation of the platinum metals.

All these processes require elaborate apparatus and technology and are therefore very cost-intensive.

Electrolytic processes for refining gold have been known for a long time (Gmelin Au, Syst. No. 62, 1949) and have been continuously developed (European Patent EP 0 253 783).

British Patent GB-PS 157 785 and the German Published Patent Application 594 408 describe electrolytic platinum refining processes, which partly use combinations of chemical and electrolytic process steps.

These processes are all very time-consuming and cannot be reproduced in a technically acceptable form in all aspects.

U.S. Pat. No. 4,382,845 describes a partial electrolytic separation of palladium from solutions containing an excess of palladium. Precipitation, however, is only possible up to the threshold at which platinum and palladium are present in equal quantities. The precipitation of remaining base and noble metals is not mentioned in this process.

In the known process for precipitating platinum and palladium the electrolysis cell comprises a cation exchanger membrane whose advantages are, however, not apparent, since platinum and palladium can also be precipitated without a cation exchanger membrane in the described concentration ratio and voltage range. Moreover, this process displays the same disadvantage as all other known processes, since it can only be operated with a maximum concentration of $\leqq 100$ g/l.

SUMMARY OF THE INVENTION

It is an object of the present invention to provide a process for obtaining platinum of high purity from a platinum alloy, in which platinum can be separated from the other alloy elements and metal impurities present to obtain platinum having a purity of 99.95% with simple equipment, in a short period of time, with minimal losses, reduced labor and without addition of expensive chemical substances.

It was surprisingly found that platinum of high purity can be obtained from platinum metal solutions containing platinum alloys by electrolytic means with simultaneous depletion of other noble metal impurities and base metal impurities originally present in the solutions.

These objects and others, which will be made more apparent hereinafter, are attained in an electrolytic process for obtaining platinum of high purity from a concentrated hydrochloric acid solution of a platinum alloy containing Rh, Ir and/or Pd and noble and base metal impurities.

According to the invention, the purification process occurs by electrolysis in an electrolysis cell having an anode and a cathode and subdivided by a cation exchanger membrane, under potentiostatic or voltage-controlled conditions with a potential applied across the anode and cathode between 8 V to 16 V and at a current density of 12.5 to 37.5 A/dm$^2$ to form a purified platinum-containing solution from which the high purity platinum is obtained and also platinum alloy metal deposits and in which the platinum alloy metal deposits are recovered.

In various embodiments of the invention, the hydrochloric acid solution of the platinum alloy has a platinum alloy content of 50 to 700 g/l and total impurities of $\leqq 5000$ ppm in relation to a platinum metal content of the concentrated hydrochloric acid solution.

In a preferred embodiment of the process according to the invention, the hydrochloric acid solution has a content of 500 to 700 g/l of platinum alloy.

The concentrated hydrochloric acid solution of the platinum alloy in the process according to the invention can have impurities containing at least one of the elements Au, Ag, Cu, Fe, Co, Ni, Sb, As, Pb, Cd, Al, Mn, Mo, Si, Zn, Sn, Zr, W, Ti and Cr.

Hydrochloric platinum metal solutions, preferably hexachloric platinum acid, are used as the anolyte, and 6 to 8N hydrochloric acid, preferably 6N hydrochloric acid, is used as the catholyte.

The anode can be made of platinum metal, while the cathode can be made of platinum metal, titanium or graphite.

A teflon membrane (Nafion ®-Membrane) is used as the preferred cation exchanger membrane loaded with sulfonic acid groups. The process according to the invention preferably operates under potentiostatic or voltage-controlled conditions in the range of 11.5 V to 12 V and at a current density of 22.5 to 35 A/dm$^2$.

The base and noble metal impurities in the platinum alloy are deposited at the cathode with minimal platinum metal content. It was surprisingly found that the platinum alloy metal components Ir, Rh and/or Pd deposit at the anode together with comparatively small quantities of platinum.

The surprising deposition of the alloy metal components at the anode is achieved as a result of a comparatively higher concentration of the platinum alloy in solution and the comparatively higher applied voltage range used in the electrolysis process according to the invention.

The deposit at the cathode is mechanically removed from the latter and separately recovered.

The Ir, Rh and/or Pd containing deposit is refined by further electrolysis after converting the deposit obtained from the anode into the solution.

The chlorine gas developing during the process according to the invention is removed by known methods.

The metallic platinum can be recovered from the solution of the platinum alloy which has been purified by the above electrolysis process according to the invention. The high purity platinum is advantageously obtained from the purified solution by electrolytic or chemical means, e.g. extraction techniques.

The process according to the invention possesses the following advantages: it requires minimal expenditure in terms of equipment and safety engineering; it causes minimal environmental burden; it is far more rapid and economical than conventional processes.

The process according to the invention will now be better understood by reference to the following examples, whose individual features are not to be considered as additional limitations of the claims appended hereinbelow.

EXAMPLES

EXAMPLE 1 Electrolytic Deposition of Platinum-Iridium-1

A hydrochloric acid solution of platinum-iridium-1 with a content of 300 g/l and the following metal impurities (the ppm amounts are in relation to the platinum metal content of the solution):

| | |
|---|---|
| Au | 20 ppm |
| Fe | 136 ppm |
| Ni | 534 ppm |
| Cu | 960 ppm |
| Pb | 24 ppm |
| Cd | 12 ppm |
| Zn | 16 ppm |

is electrolyzed in an electrolysis cell, in which cathode and anode are separated by a cation exchanger membrane, under a voltage or potential of 12 V and at a current density of 27.5 A/dm$^2$. After an electrolysis period of 20 hours, the base metals and the gold of the metal impurities are depleted from the solution and have a final concentration of less than or equal to 20 ppm, the rhodium is depleted to a concentration-of 150 ppm and the iridium to a concentration of 0.5% in the solution. The palladium precipitation occurs in a highly acidic medium in smaller concentrations.

After a further electrolysis period of 20 hours the iridium content in the solution is ≦200 ppm, the rhodium content in the solution is ≦20 ppm and the palladium content in the solution is ≦100 ppm.

EXAMPLE 2 Electrolytic Deposition of Platinum-Rhodium 5

A hydrochloric acid solution of platinum-rhodium-5 with a platinum metal content of 250 g/l and the following metal impurities (ppm amounts in relation to the platinum metal content)

| | |
|---|---|
| Ir | 250 ppm |
| Pd | 500 ppm |
| Au | 150 ppm |
| Fe | 210 ppm |
| Ni | 453 ppm |
| Cu | 760 ppm |
| Pb | 55 ppm |
| Cd | 22 ppm |
| Zn | 40 ppm |

is electrolyzed in an electrolysis cell, in which the cathode and the anode are separated by a cation exchanger membrane, under a voltage of 15 V and at a current density of 32.5 to 35 A/dm$^2$. After 20 hours the base metal impurities and the gold of the metal impurities are depleted in the solution to a concentration of less than or equal to 20 ppm, the palladium in solution is depleted to a concentration of 400 ppm and the rhodium in solution to a concentration of 1.2%. After an additional electrolysis period of 25 hours a depletion of the rhodium to a concentration of less than or equal to 200 ppm and of the palladium to less than or equal to 100 ppm is observed.

EXAMPLE 3 Electrolytic Deposition Platinum-Palladium-5

A hydrochloric acid solution of platinum-palladium-5 with a metal content of 100 g/l and the following metal impurities (ppm amounts in relation to the platinum metal content)

| | |
|---|---|
| Ir | 400 ppm |
| Rh | 450 ppm |
| Au | 80 ppm |
| Fe | 160 ppm |
| Ni | 500 ppm |
| Cu | 810 ppm |
| Pb | 76 ppm |
| Cd | 15 ppm |
| Zn | 43 ppm |

was electrolyzed in an electrolysis cell, in which cathode and anode are separated by a cation exchanger membrane, under a voltage of 11.5 V and at a current density of 22.5 A/dm$^2$. The base metals and the gold are depleted within 10 hours to contents of ≦20 ppm, the iridium and the rhodium are depleted to concentrations of ≦100 ppm and the palladium to 2.3%. After an additional electrolysis period of 15 hours depletion of the palladium to values of ≦500 ppm is achieved.

While the invention has been illustrated and described as embodied in an electrolytic process for extracting high purity platinum from platinum alloys, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. Electrolytic process for obtaining platinum of a high purity from concentrated hydrochloric acid solutions containing a platinum alloy, said process comprising the steps of:

a) providing an electrolysis cell having an anode and a cathode and a cation exchanger membrane subdividing said electrolysis cell;

b) placing in said electrolysis cell a concentrated hydrochloric acid solution containing metal impurities and a platinum alloy selected from the group consisting of Platinum-Rhodium alloys, Platinum-Iridium alloys and Platinum-Palladium alloys;

c) applying a potential across said anode and said cathode of 8 V to 16 V to perform an electrolysis under voltage-controlled conditions at a current density of 12.5 to 37.5 $A/dm^2$ so as to form a purified platinum-containing solution and at least one platinum alloy metal deposit;

d) recovering said at least one platinum alloy metal deposit; and e) obtaining the platinum of high purity from said purified platinum-containing solution.

2. Process according to claim 1, wherein said concentrated hydrochloric acid solution of said platinum alloy has a platinum alloy content of 50 to 700 g/l and a content of said metal impurities of not greater than 5000 ppm in relation to a platinum metal content of said concentrated hydrochloric acid solution.

3. Process according to claim 2, wherein said platinum alloy content of said concentrated hydrochloric acid solution is between 500 to 700 g/l.

4. Process according to claim 1, wherein said metal impurities in said concentrated hydrochloric acid solution contain at least one element selected from the group consisting of Au, Ag, Cu, Fe, Co, Ni, Sb, As, Pb, Cd, Al, Mn, Mo, Si, Zn, Sn, Zr, W, Ti and Cr.

5. Process according to claim 1, wherein said concentrated hydrochloric acid solution surrounds said anode so as to form an anolyte and is 6 to 8N in HCl, and further comprising placing a 6 to 8N concentrated hydrochloric acid solution around said cathode to provide a catholyte around said cathode.

6. Process according to claim 5, wherein said anolyte comprises hexachloric platinum acid.

7. Process according to claim 5, wherein said catholyte comprises said 6N concentrated hydrochloric acid solution.

8. Process according to claim 1, wherein said potential applied across said anode and cathode is from 11.5 to 12 V and said current density is from 22.5 to 35 $A/dm^2$.

9. Process according to claim 1, further comprising controlling said potential so that chlorine gas is generated during said electrolysis and removing said chlorine gas from said electrolysis cell.

10. Process according to claim 1, wherein said anode is made of platinum metal and said cathode is made of a member selected from the group consisting of platinum, titanium and graphite.

11. Process according to claim 1, wherein said cation exchanger membrane is a teflon membrane.

12. Process according to claim 1, wherein said at least one platinum alloy metal deposit is formed on said anode and at least one other platinum alloy metal deposit containing at least one of said metal impurities is deposited on said cathode.

13. Process according to claim 12, wherein said at least one other platinum alloy metal deposit is mechanically removed from said cathode.

14. Process according to claim 12, wherein said at least one platinum alloy metal deposit is mechanically removed from said anode, dissolved to form an anode deposit-containing solution, and further comprising purifying said anode deposit-containing solution by electrolysis.

15. Process according to claim 1, wherein said obtaining of said platinum of said high purity from said purified platinum-containing solution occurs by an electrolytic method.

16. Process according to claim 1, wherein said obtaining of said platinum of said high purity from said purified platinum-containing solution occurs by chemical means.

17. Process according to claim 1, wherein said potential is applied across said anode and said cathode during said electrolysis under potentiostatic conditions.

18. Electrolytic process for obtaining a purified platinum-containing solution from a concentrated hydrochloric acid solution containing at least one platinum alloy and metal impurities, said process comprising the steps of:

a) providing an electrolysis cell having an anode and a cathode and a cation exchanger membrane subdividing said electrolysis cell;

b) placing in said electrolysis cell a concentrated hydrochloric acid solution containing not greater than 5000 ppm of the metal impurities in relation to a platinum metal content of said concentrated hydrochloric acid solution and 50 to 700 g/l of a platinum alloy selected from the group consisting of Platinum-Rhodium alloys, Platinum-Iridium alloys and Platinum-Palladium alloys, said metal impurities containing at least one element selected from the group consisting of Au, Ag, Cu, Fe, Co, Ni, Sb, As, Pb, Cd, Al, Mn, Mo, Si, Zn, Sn, Zr, W, Ti and Cr;

c) applying a potential across said anode and said cathode of 8 V to 16 V to perform an electrolysis under voltage-controlled conditions at a current density of 12.5 to 37.5 $A/dm^2$ so as to form the purified platinum-containing solution and at least one platinum alloy metal deposit; and d) recovering said at least one platinum alloy metal deposit.

19. Process according to claim 18, wherein said concentrated hydrochloric acid solution surrounds said anode so as to form an anolyte and is 6 to 8N in HCl, and further comprising placing a 6 to 8N concentrated hydrochloric acid solution around said cathode to provide a catholyte around said cathode.

20. Process according to claim 18, wherein said potential applied across said anode and cathode is from 11.5 to 12 V and said current density is from 22.5 to 35 $A/dm^2$.

21. Process according to claim 18, wherein said potential is applied across said anode and said cathode during said electrolysis under potentiostatic conditions.

22. Process according to claim 18, further comprising controlling said potential so that chlorine gas is generated during said electrolysis and removing said chlorine gas from said electrolysis cell.

23. Process according to claim 18, wherein said anode is made of platinum metal and said cathode is made of a member selected from the group consisting of platinum, titanium and graphite.

24. Process according to claim 18, wherein said cation exchanger membrane is a teflon membrane.

25. Process according to claim 18, further comprising the step of obtaining a platinum of high purity from said purified platinum-containing solution formed during said electrolysis.

26. Process according to claim 25, wherein said obtaining of said platinum of said high purity from said purified platinum-containing solution occurs by an electrolytic method.

27. Process according to claim 25, wherein said obtaining of said platinum of said high purity from said purified platinum-containing solution occurs by chemical means.

* * * * *